United States Patent [19]

von der Eltz

[11] 4,082,504

[45] Apr. 4, 1978

[54] PROCESS FOR THE CONTINUOUS DYEING OF CELLULOSE FIBERS OR MIXTURES THEREOF WITH SYNTHETIC FIBERS WITH WATER-INSOLUBLE AZO DYESTUFFS DEVELOPED ON THE FIBER

[75] Inventor: Hans-Ulrich von der Eltz, Frankfurt am Main, Germany

[73] Assignee: Hoechst Aktiengesellschaft, Frankfurt am Main, Germany

[21] Appl. No.: 720,070

[22] Filed: Sep. 2, 1976

[30] Foreign Application Priority Data

Sep. 4, 1975 Germany ..... 2539336

[51] Int. Cl.[2] ..... C09B 27/00; D06B 1/00

[52] U.S. Cl. ..... 8/44; 8/21 C; 8/51; 8/54.2; 8/152; 68/177; 68/178

[58] Field of Search ..... 8/44, 152, 46; 68/178

[56] References Cited

U.S. PATENT DOCUMENTS

| | | | |
|---|---|---|---|
| 2,460,206 | 1/1949 | Wentz | 8/149.1 |
| 3,042,480 | 7/1962 | Chipalkatti et al. | 8/151 |
| 3,677,695 | 7/1972 | Peter | 8/152 |
| 3,698,212 | 10/1972 | Ameling et al. | 68/178 |
| 3,952,558 | 4/1976 | Sandberg et al. | 8/152 |
| 3,966,406 | 6/1976 | Namiki et al. | 8/152 |

OTHER PUBLICATIONS

R. W. Moncrieff, "Man-Made Fibres" (Wiley, New York) 1974, pp. 855–856.

R. H. Peters, "Textile Chemistry" (Elsevier, Amsterdam) 1975, pp. 22–23.

*Primary Examiner*—A. Lionel Clingman

*Attorney, Agent, or Firm*—Curtis, Morris & Safford

[57] ABSTRACT

Process for the continuous dyeing of textile material made of cellulose fibers or their mixtures with synthetic fibers in the form of endless ropes by developing water-insoluble azo dyestuffs on the fiber, which comprises impregnating the textile material at first with the alkaline bottoming bath by means of a Venturi tube or a system of Venturi tubes and then, optionally after intermediate rinsing or dwelling, treating the textile material with the acidic developing liquor and aftertreating and finishing it in the usual manner.

14 Claims, 2 Drawing Figures

Figure 1:
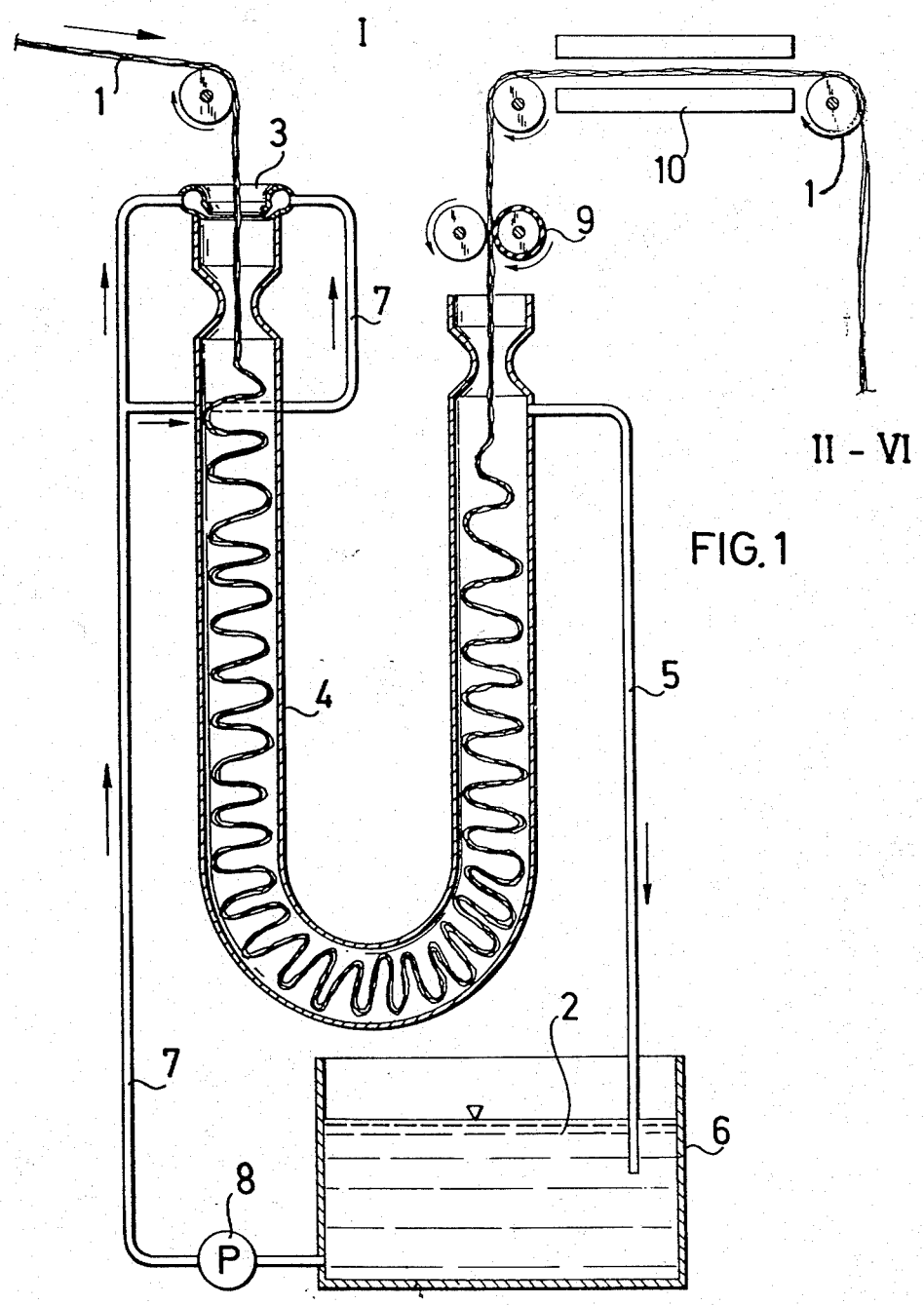

PROCESS FOR THE CONTINUOUS DYEING OF CELLULOSE FIBERS OR MIXTURES THEREOF WITH SYNTHETIC FIBERS WITH WATER-INSOLUBLE AZO DYESTUFFS DEVELOPED ON THE FIBER

The present invention relates to a process for the continuous dyeing of cellulose fibers or mixtures thereof with synthetic fibers with water-insoluble azo dyestuffs developed on the fiber.

It is known that woven or knits made of cellulose fibers in rope form are dyed on the winch according to the ice-color technique using developing dyestuffs. In this process, water-insoluble azo dyestuffs are developed on the fiber. According to this discontinuous dyeing method, the textile material is at first treated with the alkaline solution of the coupling component (bottoming bath), intermediate rinsing and centrifuging follow, then the material is treated with the acidic bath of the diazo component (developing bath), whereupon the water-insoluble azo dyestuff is developed in the fiber. Finally, the dyeing obtained is rinsed, soaped and dried.

But this dyeing process has drawbacks. For example, it is too time-consuming because several separated operational steps are necessary; it is sometimes difficult to obtain abrasion-fast, intense dyeings (bottoming has sometimes to be done twice using medium amounts of coupling component with intermediate rinsing); the levelness of the dyeings is not always as satisfactory as desired.

Now, it was found that textile material made of cellulose fibers in rope form can be dyed in a continuous process by developing water-insoluble azo dyestuffs on the fiber, with a minor time-expenditure, and whereupon abrasion-fast, intense dyestrings are obtained without difficulties, the levelness of the dyeing is satisfactory and especially small goods-to-liquor ratios, e.g. 1:3 to 1:8, can be used.

The present invention provides a process for the continuous dyeing of textile material made of cellulose fibers or their blends with synthetic fibers in the form of endless ropes by developing water-insoluble azo dyestuffs on the fiber, which comprises impregnating the textile material at first with the alkaline bottoming bath by means of a Venturi tube or a system of Venturi tubes, treating the textile material optionally after intermediate rinsing or dwelling, with the acidic developing bath and after-treating and finishing it in the usual manner.

It was surprising and could not be foreseen that the process of the invention produced the desired result, because dyeings without levelness and fastness to abrasion, at least locally, had rather been expected due to the fact that the bath hits the textile material with a relatively hard blow and the necessarily twisted ropes do not allow an even penetration of the textile material. But in carrying out the process of the invention, it became evident that the rope of textile material was favorably opened by the liquor streaming through.

Textile material made of cellulose fibers in rope form in the scope of the claimed process are wovens or knits in rope form or hanks of fibers, filaments or yarns consisting of natural or regenerated cellulose fibers or filaments (for example spun rayon) or containing those fibers or filaments for example in mixture with synthetic fibers or filaments. Synthetic mixing components are preferably fibers and filaments made of polyester.

Coupling components for the bottoming baths are, according to the invention, the substances well-known from the ice-color technique. The compounds to be considered are those in which coupling occurs in a position neighboring a hydroxy group and which contain no solubilizing groups, especially aryl amides of aromatic or heterocyclic o-hydroxy-carboxylic acids or of acylacetic acids and other aromatic or heterocyclic hydroxy compounds and compounds which contain an enolizable or enolized ketomethylene group which is situated in a heterocyclic ring. Substances of this sort are, for example aryl amides of the 2,3-hydroxynaphthoic acid, the 2-hydroxyanthracene-3-carboxylic acid, the 4-hydroxydiphenyl-3-carboxylic acid, the 2-hydroxycarbazole-3-carboxylic acid, the 3-hydroxydiphenyleneoxide-2-carboxylic acid, the 3-hydroxydiphenylenesulfide-2-carboxylic acid, of the acetoacetic acid or the benzoylacetic acid. Further suitable substances are hydroxybenzenes, polyhydroxybenzenes, hydroxynaphthalenes and pyrazolones which may be substituted by non-ionic radicals.

Diazo components for the developing baths are the primary aromatic amines well-known in the ice-color technique which yield — after diazotization — with the coupling components mentioned water-insoluble mono, dis or polyazo dyestuffs. Other amines of this type are tetrazonium compounds of aromatic diamines and aminoazo dyestuffs.

According to the process of the invention the azo dyestuffs can be dyed on the fiber by the usual method of the ice-color technique by applying at first the alkaline aqueous solution of the coupling component and afterwards the acidic solution of the diazo component. This process also allows the following variants:

1. The bottoming bath additionally contains the nitrite required for the diazotization. The acidic developing bath contains the free amine. Advantage: the developing bath has a practically unlimited durability.

2. The bottoming bath additionally contains the diazo component as free amine. The developing bath contains the nitrite and the acid required for the diazotization of the diazo component. Advantage: thorough penetration of the rope by the diazo component before starting coupling.

3. The bottoming bath additionally contains the diazo component as free amine and the nitrite required for the diazotization of the diazo component. The developing bath only contains the acid and optionally a surfactant and a buffering agent for adjusting the pH. Advantage: stable developing bath which can have a long goods-to-liquor ratio. The after-treatment is so facilitated and shortened.

In the process according to the invention it is preferred to apply also the developing bath by means of a Venturi tube or a system of Venturi tubes. The advantage thereof is that the pH required for coupling is extremely rapidly adjusted also in the interior of the textile rope.

The most favorable embodiment of the process of the invention is to plaid down the impregnated material for a short time after applying the bottoming bath by means of a system of Venturi tubes or to rinse it intermediately by means of a system of Venturi tubes, then to apply the developing bath by means of a system of Venturi tubes and subsequently to rinse and wash also by means of a system of Venturi tubes.

In the process of the invention we employ the usual agents in the ice-color technique for the intermediate rinsing, rinsing and washing baths.

According to this invention, the material is forwarded in a continuous passage along with the heavy bath stream leaving the Venturi tubes. The textile ropes are introduced with the flowing liquor, for example into a U-shaped recipient, continuously forwarded in folded state, continuously taken at the end of the U-tube and subjected to further analogous steps of treatment. The bath stream and the pressure in the U-tube favor the even and rapid penetration of the rope by the bath.

The series connection of several U-tubes that are provided with Venturi tubes allows the textile rope advantageously to undergo several different treatments in the scope of the production of azoic development dyestuffs.

The individual process of treatment may be based, for example on the following operational steps:

I Pre-treatment, for example hot wetting or boiling out, etc.
II Bottoming
III Intermediate rinsing
IV Development
V Rinsing or soaping at 60° C
VI Soaping at the boil, etc.

Owing to the fact that the individual processes of treatment are functionally similar, it is possible (for example in the case of absorbent dry material) to carry out the bottoming in the first treatment process (I) without any pretreatment as the first step. In some variants of the process, intermediate rinsing does not take place, so that bottoming is followed immediately by the developing process. In some cases it is possible to use two or several boxes for the same process (bottoming or development).

After terminating the said process of treatment, the moist material is generally moved forward by the following tube. The intermediate passage may also occur via winches or sieve drums, which are followed by a Venturi tube for the next wet treatment.

Various tube diameters — in each Venturi tube the diameter insets are rapidly replaceable — allow the adaptation to various rope diameters, the difference of the diameters being due to the different density or thickness of the wovens or knits.

In the process of the invention, yarn hanks, such as, for example those which can be taken off from a direct warp beam or a warp beam, can be dyed continuously.

Figure 2:
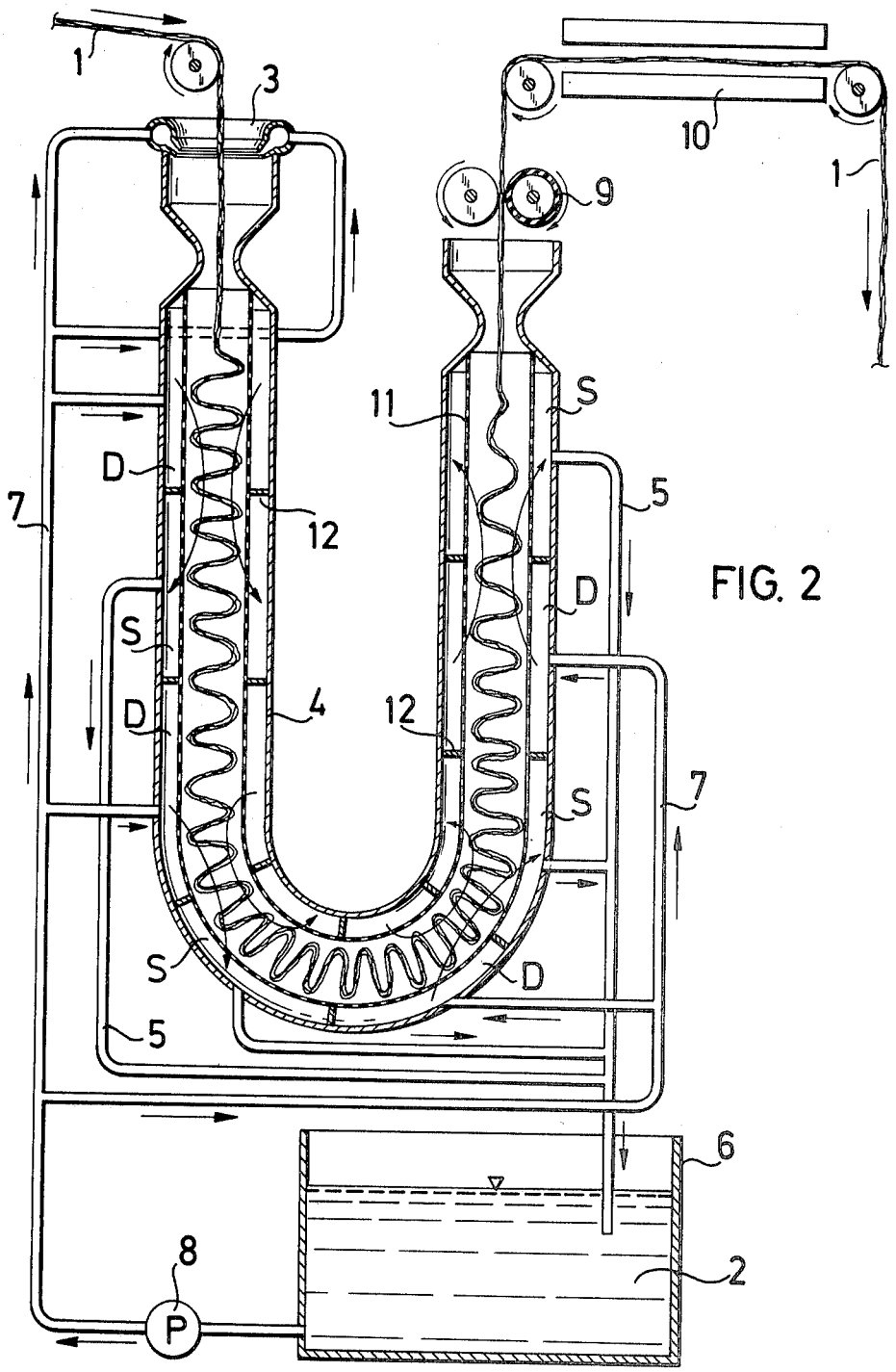

A device of a U-shaped tube system suitable for carrying out the process of this invention is illustrated diagramatically by way of example in the accompanying drawing. Referring to the drawing, FIG. 1 shows a single element for treating with Venturi tubes of the simple type, FIG. 2 is a special embodiment of the device used according to the invention on the basis of a U-shaped dwell box with perforated inner surface. The interspace is divided into compartments. In alternating order, impregnation liquor is fed into and liquor is suctioned out of these compartments. The liquor leaves the compartments (D) fed with impregnation liquor through the perforated surface to enter into the dwelling compartment, flows through the material and is suctioned through the perforation leading to the suction chambers (S).

According to this advantageous arrangement, the textile material can be kept back while the impregnation liquor flows through the perforated metal sheet, is collected, and if desired, led to the following Venturi tube.

The reference numbers used in FIG. 1 and in FIG. 2 have the meanings given hereinafter:

(1) rope of textile material
(2) liquor of treatment
(3) jet pitot-heated tubes (Venturi tubes) (liquor flow serving as means of conveyance)
(4) dwell box
(5) liquor outlet, if desired, in the form of a liquor suction pipe (FIG. 2)
(6)liquor storage or collecting vessel provided with inlet (5) and feeding back pipe (7)
(7) feeding back pipe for liquor, if desired, designed as liquor discharge pipe (FIG. 2)
(8) circulation pump for liquor
(9) drain system, e.g. squeezing device having smooth profiled rollers (driven)
(10) heat exchange zone for heating and cooling
(11) perforated inner surface
(12) separating walls of compartments.

The arrows to be found in the figures denote the flow direction of the liquor in the dwell box which corresponds to that in the rope of textile material.

The following Examples illustrate the invention.

EXAMPLE 1

Cotton tricot wetted in advance, a tubular knitted fabric in rope form having a content of moisture of 60% calculated on the dry weight, is introduced into the U-shaped dwell box in the bottoming part (I) of the continuous apparatus through a jet of the bottoming liquor via a circular tube and a jet pitot-head tube (Venturi tube) and bottomed during this operation. The aqueous bottoming liquor (20° C) contains per liter:

1.5 g of the coupling component Azoic Coupling Component 12 (C.I. No. 37 550), dissolved according to the usual cold dissolving process
6 $cm^3$ of sodium hydroxide solution of 32.5%
3 $cm^3$ of formaldehyde of 33%
3 g of a non-foaming dispersing agent on the basis of a condensation product of naphthalene sulfonate and formaldehyde
20 g of sodium chloride.

During the passage and the period of dwell in the U-shaped dwell box the concentration equilibrium of the naphtholate which has affinity to the cotton fiber is rapidly established betweenthe liquor and the fiber.

Before dewatering of the rope, for example by a squeezing device, the nearly exhausted bottoming liquor leaving the dwell box at its outlet is collected and brought to the original concentration in batches of 250 l by adding naphtholate and sodium hydroxide solution, it is led back into the circulating liquor whereby the loss of liquor is replenished.

Without being stopped, textile rope is forwarded, optionally after a short storage time, into the second compartment (II) for intermediate rinsing, in which it is forced along with a sharp jet (coming out of a circular tube via a further jet pitot-head tube) of the intermediate rinsing liquor. These aqueous intermediate rinsing liquors of 10° to 20° C contain 30 g/l of sodium chloride. The rope is forwarded through the second dwell box while the liquor is circulating. Further feeding is not necessary but the liquor must entirely be renewed after the passage of a certain quantity of material (for example 300 kg).

In an analogous manner, the textile rope is introduced into the third dwell box of the third compartment (III) (development) along with the jet of the cold developing liquor.

The aqueous developing liquor contains per liter:

6.7 g of the stabilized diazonium compound of the primary, aromatic amine Azoic Diazo Component 42, C.I. No. 37,150
2 $cm^3$ of the acetic acid of 60%
10 g of sodium acetate
1 g of non-ionic dispersing agent based on oxethylates (for example isotridecyl alcohol + 8 ethylene oxide per mol).
30 g of sodium chloride.

The liquor used is also recycled after increasing the concentration.

The period of dwell in each box is about 5 to 10 minutes. Cold rinsing follows in an analogous manner (IV) using fresh water and soaping in alkaline medium approximately at the boiling temperature (V). The extremely thorough penetration of the rope by the liquor first in longitudinal direction, then from all directions in the dwell box owing to the eddy-motion gives wholly level and abrasion-fast red dyeings obtained in a continuous manner.

EXAMPLE 2

The process is carried out as described in Example 1, but a hot (95° C) bottoming bath (I) is used containing 1.2 g/l of the Azoic Coupling Component 28, C.I. No. 37 541, for the rest, the composition is the same; 6.5 g/l of the diazonium compound of the primary, aromatic amine Azoic Diazo Component 11, C.I. No. 37 085, in the developing bath (II), for the rest, the composition is the same.

A level, entirely red dyeing is obtained on the cotton tricot having a good fastness to abrasion.

EXAMPLE 2a

When instead of the cotton tricot a non-treated, crude material is used, a level red dyeing having a good fastness to abrasion is obtained.

EXAMPLE 3

The process is carried out as in Example 1, but the bottoming liquor (I) (20° C) is used which contains in the liter 35 g of sodium nitrite.

An intermediate rinsing bath does not take place.

The aqueous developing bath contains as (non diazotized) primary amine per liter:

2 g of the Azoic Diazo Component 1, C.I. No. 37,135 in the form of a 50% aqueous dispersion, dispersed with a non-ionic polyalkylene glycol ether (e.g. isotridecyl alcohol + 8 ethylene oxide per mol),
4 $cm^3$ of acetic acid (60%)
4 $cm^3$ of formic acid (85%) at a temperature of 40° C.

A level bordo dyeing having a good fastness to abrasion is obtained.

EXAMPLE 4

A pretreated cotton tricot having a content of moisture of 60% is introduced in rope form in the bottoming bath (I) of the continue device along with the jet of the bottoming bath leaving a circular tube via a jet pitot-head tube into the U-shaped dwelling compartment of the device and bottomed with an aqeuous liquor of 20° C which contains in the liter:

1.5 g of the Azoic Coupling Component 3 (C.I. No. 37,575), dissolved according to the usual cold dissolving method,
6 $cm^3$ of sodium hydroxide solution of 32.5%
3 $cm^3$ of formaldehyde of 33%
3 g of 2,2'-dinaphthylmethane-6,6'-disulfonic acid sodium
and 2 g of Azoic Diazo Component 42 (C.I. No. 37 150) in the form of the free amine, previously dissolved in 5 g of dimethyl sulfoxide and dispersed in a little water with the aid of 1 g of oleylmethyl taurine,
6 g of sodium nitride
10 g of sodium acetate
and 20 g of sodium chloride.

After leaving the bottoming compartment and squeezing off the moisture content in the material is 200%.

The period of dwelling in the box is 8 minutes.

After increasing the concentration with 4 g/l o the above Azoic Coupling Component and
2 g/l of the above Azoic Diazo Component and replacing the amount of liquor lost and the chemical substances contained therein the liquor is recycled into the system.

Development occurs immediately in the following compartment (II) also provided with a circular tube in an analogous manner as the bottoming with a cold (20° C) aqueous liquor consisting of 4 $cm^3$/1 of acetic acid (60%)
4 $cm^3$/1 of formic acid (80%).

Half of the liquor lost ist rejected and replaced by new liquor. The development to the dyestuff is completed in the third compartment (III) having the same design as compartments I and II by treating it at 60° C with an aqueous liquor consisting of 0.5 $cm^3$/1 of sodium hydroxide solution (10%)
0.5 $cm^3$/1 of calcined sodium carbonate solution and
0.5 g/1 of oleyl methyl taurine.

In the last compartment (IV) of the same design the material is treated with a liquor of the same composition but at the boiling temperature. Then, the dyeing is rinsed cold and the rope is dried.

A level, abrasion-fast brown dyeing is obtained.

EXAMPLE 5

300 spools charged with 700 g of crude cotton yarn Nm 40 is stretched on a cop creel, at its exit the 300 threads are taken together to form a rope, tied together at the beginning and so forwarded to the first compartment (I) of the continue device to carry out the process of the invention. The rope is introduced with the jet coming out of a circular tube into the U-shaped dwelling box together with the a hot (90° C) aqueous liquor containing 0.5 $cm^3$/l of sodium hydroxide solution (10%)
1 g/l of diisobutylnaphthalene sulfonic acid sodium.

The period of dwell in the box is 6 minutes. The rope is forwarded to the second compartment of the continue device (II) via a squeezing device which squeezes off the rope to a residual moisture of 60%.

The liquor excess of the first compartment is forwarded via a batch vessel and a pump to the circular tube. The liquor absorbed by the material is supplemented in the batch vessel.

The rope is introduced along with an aqueous liquor of 20° C into the second compartment. The liquor contains per liter 1.5 g of Azoic Coupling Component 12 (C.I. No. 37 550), dissolved according to the usual cold dissolving process,
6 $cm^3$ of sodium hydroxide solution of 32.5%
6 $cm^3$ of sodium hydroxide solution of 32.5%
20 g of sodium chloride.

The suction-filtered and squeezed liquor at the outlet of the box is recycled after supplement of the loss of liquor and increasing the concentration by means of 4 g of the Azoic Coupling Component 12 (see above) via an intermediate recipient into the circulation system of the second compartment.

The textile rope reaches the third compartment (III) via the squeezing device of the second compartment which provides a moisture content of 60%.

It is introduced therein along with the aqueous liquor which consists of
6.7 g of the stabilized diazonium compound of the Azoic Diazo Component 42 (C.I. No. 37 150),
2 $cm^3$ of acetic acid of 60%
10 g of sodium acetate
1 g of a non-ionic dispersing agent (e.g. isotridecyl alcohol + 8 ethylene oxide per mol)
30 g of sodium chloride
in the liter of water of 20° C. At this point, dyestuff development starts.

In the following compartments IV, V and VI the following operations are carried out in an analogous manner:
rinsing in compartment IV with cold water,
soaping at 60° C in compartment V with an aqueous liquor containing 0.5 g/l of calcined sodium carbonate and 1 g/l of oleylmethyl taurine,
and soaping at the boil in compartment VI with a liquor having the same composition as in V.

At the outlet of the sixth compartment the textile rope is conducted through a circular spray nozzle, washed out of it with cold water, squeezed and dried.

An entirely level and abrasion-fast red dyeing is obtained.

What is claimed is:

1. A process for the continuous dyeing of fibers or filaments of natural or regenerated cellulose, or of a material comprising fibers or filaments of natural or regenerated cellulose, in rope form, which comprises:
applying to the rope, by means of at least two dyeing liquors, the components for producing a water-insoluble developing azo dyestuff on the fibers or filaments, the first dyeing liquor applied to the rope being an alkaline liquor containing a dyestuff coupling component and bein applied to passing the rope through a conduit having a constriction therein and a liquor application jet or jets positioned at or before the constriction, such that the applied liquor has an opening effect on the rope.

2. A process as claimed in claim 1, wherein two dyeing liquors are applied to the rope, the second dyeing liquor containing an acid and a dyestuff diazo component.

3. A process as claimed in claim 1, wherein two dyeing liquors are applied to the rope and wherein the first dyeing liquor also contains a nitrite and the second dyeing liquor contains an acid and an amine which is capable of reacting with the nitrous acid which is set free from the acid and the nitrite to form a dyestuff diazo component.

4. A process as claimed in claim 1, wherein two dyeing liquors are applied to the rope and wherein the first dyeing liquor also contains an amine which is capable of reacting with the nitrous acid which is set free from the acid and the nitrite to form a dyestuff diazo component and the second dyeing liquor contains an acid and a nitrite.

5. A process as claimed in claim 1, wherein two dyeing liquors are applied to the rope and wherein the first dyeing liquor also contains a nitrite and an amine which is capable of reacting with the nitrous acid which is set free from the acid and the nitrite to form a dyestuff diazo component and the second dyeing liquor contains an acid.

6. A process as claimed in claim 1, wherein the first dyeing liquor is applied to the rope in two or more stages.

7. A process as claimed in claim 1, wherein the second dyeing liquor is applied to the rope in one or more stages, the application of said second dyeing liquor being in the manner recited in claim 9 for the first dyeing liquor.

8. A process as claimed in claim 1, wherein the rope is subjected to an intermediate rinsing after application of the first dyeing liquor, the rinsing liquor being applied in one or more stages in the manner recited in claim 9 for the first dyeing liquor.

9. A process as claimed in claim 1, wherein the dyed fibers or filaments are subjected to an aftertreatment, the aftertreatment liquor being applied in one or more stages in the manner recited in claim 9 for the first dyeing liquor.

10. A process as claimed in claim 1, wherein the rope impregnated with the first dyeing liquor is allowed to dwell before application of the second dyeing liquor.

11. A process as claimed in claim 1, wherein dyeing liquor is applied to the rope in a goods-to-liquor ratio in the range of from 1:3 to 1:8.

12. A process as claimed in claim 1, wherein the fibers or filaments of natural or regenerated cellulose are in a mixture with synthetic fibers.

13. A process as claimed in claim 12, wherein the synthetic fibers are polyester fibers.

14. A process as claimed in claim 1, wherein yarn rope is dyed.

* * * * *